US005833307A

United States Patent [19]

Leach et al.

[11] Patent Number: 5,833,307

[45] Date of Patent: Nov. 10, 1998

[54] MODIFIED ROCKER CONVERSION UNIT

[75] Inventors: Thomas R. Leach, 3625 S. Mohawk Rd., Midway, Tenn. 37809; Mark S. Williams, Bluff City, Tenn.

[73] Assignee: Thomas R. Leach, Midway, Tenn.

[21] Appl. No.: 900,635

[22] Filed: Jul. 25, 1997

Related U.S. Application Data

[63] Continuation-in-part of Ser. No. 676,532, Jul. 9, 1996, Pat. No. 5,660,431.

[51] Int. Cl.[6] ..... A47C 13/00

[52] U.S. Cl. ..... 297/133; 297/272.1

[58] Field of Search ..... 297/272.1, 258.1, 297/133; 403/256, 297, 240, 257, 259, 261

[56] References Cited

U.S. PATENT DOCUMENTS

| | | | |
|---|---|---|---|
| 145,036 | 11/1873 | Wilcox et al. | 297/133 |
| 304,435 | 9/1884 | Malick | 297/133 |
| 315,369 | 4/1885 | Work | 297/133 |
| 381,878 | 4/1888 | Holman | 297/133 X |
| 4,079,991 | 3/1978 | Harris | 297/133 |
| 4,126,353 | 11/1978 | Clough | 297/272.1 X |
| 5,647,682 | 7/1997 | Riehm | 403/297 |
| 5,657,604 | 8/1997 | Malott | 403/297 X |
| 5,702,152 | 12/1997 | Shaw | 297/133 |

FOREIGN PATENT DOCUMENTS

| | | | |
|---|---|---|---|
| 2014314 | 10/1971 | Germany | 297/272.1 |

*Primary Examiner*—Peter M. Cuomo
*Assistant Examiner*—David E. Allred
*Attorney, Agent, or Firm*—Pitts & Brittian, P.C.

[57] ABSTRACT

A rocker conversion unit for a molded, stackable lawn-type chair. The rocker conversion unit has an upwardly curved channel shaped rocker having elongated base means adapted to provide the bottom of said rocker and to contact and rock on lawn or other supporting surface, first and second side means integrally connected to opposite edges of said base means and extending upwardly therefrom along substantially the full length thereof. The channel has a substantially uniform side-to-side width and base-to-shoulder height throughout its length and foot retainers to engage the lateral foot segment of a mold lawn chair in a tight frictional fit that locks the chair leg into the channel and stabilizes the rocker on the chair leg.

6 Claims, 6 Drawing Sheets

MODIFIED ROCKER CONVERSION UNIT

This application is a Cont. in part of my earlier filed application, Ser. No. 08/676,532, filed on Jul. 9, 1996, now U.S. Pat. No. 5,660,431.

DESCRIPTION

1. Technical Field

This invention concerns modern casual or lawn-type chairs, typically of plastic molded construction, and the means for converting them to rocking chairs, wherein the chair legs themselves are of special construction which lends to rapid and structurally stable assembly to complimentary structure of a pair of rockers specially configured in accordance with the present invention.

2. Background Art

Heretofore, variously structured rockers have been proposed for use with conventionally shaped chairs for converting them to rocking chairs. Typical of such rockers are those shown in U.S. Pat. Nos. 1,367,390; 5,246,268; 264,917; 304,435; and 405,919.

The various types of devices shown in these patents for connecting the chair legs to the rockers have taken the forms which have been found effective for clamping the rockers to the leg ends with considerable lateral forces such as are required to prevent surface-to-surface slippage between the adjacent portions of either the legs and rockers, or between the adjacent portions of the clamping device and rocker or chair leg. Such clamping forces are quite necessary for offsetting the substantial and generally vertically directed forces which normally tend to dislodge the rockers from the chair legs during the rocking cycle.

With the advent of modem plastic molded chairs with their rather flimsy leg constructions, the types of clamping devices as described above cannot afford a satisfactory structurally stable and quick connect and disconnect connecting means between the rockers and the modem chair legs. For example, significant lateral forces applied to the edge of one of the leg sections could easily deform the leg and destroy the connection to the rocker. Accordingly, it is an object of the present invention to provide specially constructed units of rockers and friction fittings for connecting the relatively weak plastic molded legs of a modem lawn-type chair to said rockers, in a quick connect and disconnect manner.

A further object is to provide said units in lightweight, inexpensive, and easily manufacturable form, which lends to providing the unit in selected dimensions for accommodating a variety of molded chair legs.

Other objects and advantages over the prior art will become apparent to those skilled in the art upon reading the detailed description together with the drawings as described as follows.

DISCLOSURE OF THE INVENTION

The above and further objects hereinafter becoming evident have been attained in accordance with the present invention thru the discovery of a rocker conversion unit which unit is defined in its broad embodiment as an upwardly curved channel shaped rocker having elongated base means adapted to provide the bottom of said rocker and to contact and rock on a floor or lawn or other supporting surface, first and second side means integrally connected to opposite edges of said base means and extending upwardly therefrom along substantially the full length thereof to provide a generally upwardly opening channel having a longitudinal plane, lip means on the inside surface of each said side means and extending substantially the entire length of said side means adjacent the upper edge portion thereof and directed inwardly toward said plane at a substantially uniform distance above said base means, each said lip means providing a first shoulder means downwardly facing and adapted to provide a stop for preventing withdrawal of structure upwardly from said channel, said channel having a substantially uniform side-to-side width and base-to-shoulder height throughout its length, block means slidable within said channel, a second and upwardly facing shoulder means extending along each side edge of said block means and adapted to engage a first shoulder means and be stopped in its upward movement thereby, said block means having a height dimension from its bottom to its second shoulder means which is less than the base-to-shoulder height dimension of said channel to provide a space in which a lateral foot segment of a molded lawn chair leg can be positioned, and wherein said block means further comprises manually operable pressure means adapted to simultaneously force a lower portion thereof downwardly against said foot segment and to force said second shoulder means thereof upwardly against said first shoulder means whereby said foot segment is rigidly, frictionally locked in position against said base means and said rocker is stabilized on said chair.

BRIEF DESCRIPTION OF THE DRAWINGS

The invention will be further understood from the accompanying drawings of certain preferred embodiments and description thereof wherein the necessary spacings between portions of the block means and rocker for allowing sliding of the block means within the channel are not shown but are to be understood.

BEST MODE FOR CARRING OUT THE INVENTION

Figure 1:
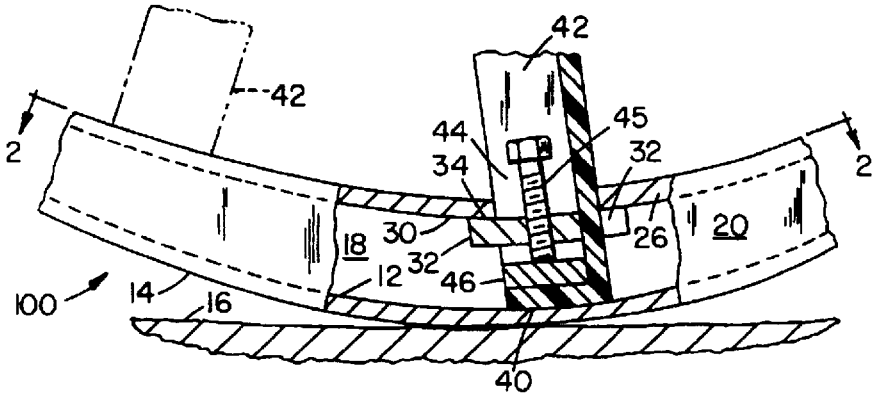
FIG. 1 is a side view of a rocker embodying the present invention, with portions of a molded plastic chair leg secured thereto and portions of the leg and rocker shown in cross-section for clarity.

A rocker conversion unit, broadly comprising a channel shaped rocker member, constructed in accordance with the present invention, is illustrated generally as 100 in the figures. The present rocker conversion unit in a broad embodiment comprises an upwardly curved, channel shaped rocker 100 having elongated base means 12 adapted to provide the bottom 14 of said rocker and to contact and rock on a floor 16 or lawn or other supporting surface, first 18 and second 20 side members integrally connected to opposite longitudinal edges of said base means and extending upwardly therefrom along substantially the full length thereof to provide a generally upwardly opening channel 22 a longitudinal plane 24, lip means 26 on the inside surface of each said side means and extending substantially the entire length of said side means adjacent the upper edge portion 28 thereof and directed inwardly toward said plane at a substantially uniform distance above said base means, each said lip means providing a first shoulder means 30 downwardly facing and adapted to provide a stop for preventing withdrawal of structure upwardly from said channel, said channel having a substantially uniform side-to-side width and base-to-shoulder height throughout its length, block means 32 sidable within said channel, a second and upwardly facing shoulder means 34 extending along each side edge of said block means and adapted to engage a first shoulder means 30 and be stopped in its upward movement thereby, said block means having a height dimension from its bottom 36 to its second shoulder means 34 which is less than the base-to-shoulder height dimension of said channel to provide a space 38 in which a lateral foot segment 40 of a molded lawn chair leg 42 can be positioned, and wherein said block means further comprises manually operable pressure means 44 adapted to simultaneously force a lower portion 46 thereof downwardly against said foot segment and to force said second shoulder means thereof upwardly against said first shoulder means whereby said foot segment is rigidly, frictionally locked in position against said base means 12 and said rocker is stabilized on said chair.

Rocker 100 is preferably constructed of heavy molded plastic such as poly (vinyl chloride) (PVC), cellulose acetate butyrate, layered epoxy or polyester resin impregnated fiberglass mat, polyamide, polycarbonate, or the like, or it may be of wood or metal, i.e., aluminum or steel.

Figure 3:
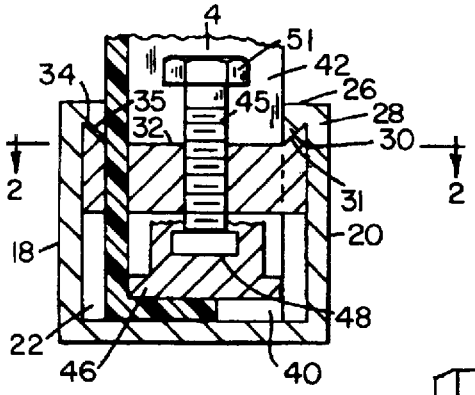
FIG. 3 is a view taken along line 3—3 of FIG. 2 in the direction of the arrows.

In the embodiment of FIG. 3 the lip means 26 are provided on their undersides with outwardly angled first shoulder means 30 which act as first cam surfaces 31. For this embodiment, the second shoulder means 34 on the upper edge portions of block means 32 are inwardly angled to act as complimentary second cam surfaces 35. In operation, block means 32 is forced upwardly by pressure means 44 and as these cam surfaces engage, further upward movement of the block means results in inward gripping movement of upper edge portions 28 of the channel sides toward the chair leg and further stabilizes the rocker on the chair.

Figure 2:
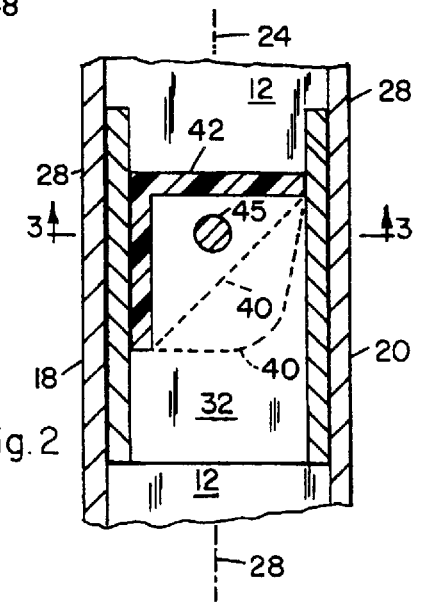
FIG. 2 is a view taken along line 2—2 of FIG. 1 in the direction of the arrows with portions broken away for clarity.

The block means 32 as shown is a preferred configuration, however, any shape thereof may be adopted as long as the cooperation of forces generated by the block means downwardly on the foot segment 40 of the chair leg and upwardly on the underside of the lip means 28 is such that the leg is locked securely in place in the rocker channel. Segment 40 may be of any shape such as the diagonal dotted line 40 or line 40' as shown in FIG. 2.

Figure 5:
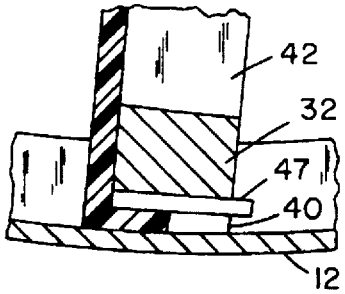
FIG. 5 is a partial view as in FIG. 3 showing a wedge variation of the pressure means.
Figure 8:
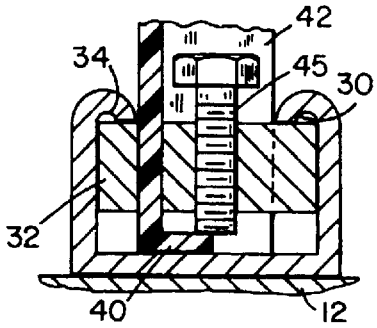
FIG. 8 is a view as in FIG. 3 showing a shape variation of the first and second shoulder means.
Figure 6:
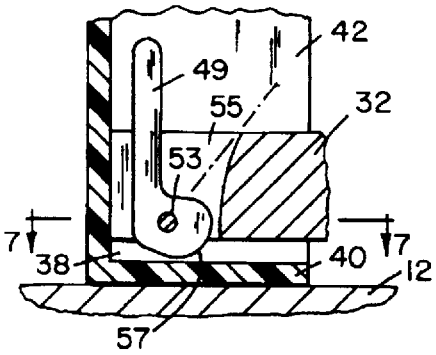
FIG. 6 is a partial view as in FIG. 3 showing a cam variation of the pressure means.
Figure 7:
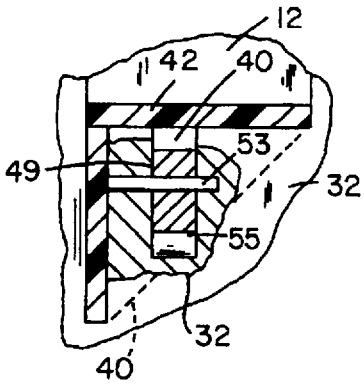
FIG. 7 is a cross-sectional view taken along line 7—7 of FIG. 6 in the direction of the arrows.
Figure 4:
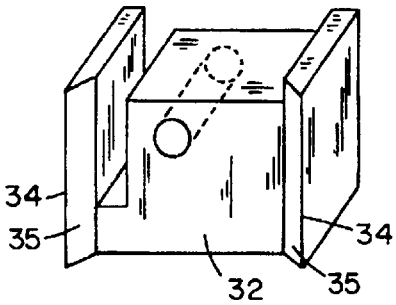
FIG. 4 is an isometric view of the block means of FIGS. 1–3.

The pressure means generally designated 44 can be of any type, e.g., the screw type 45 of FIG. 3, the wedge type 47 of FIG. 5 or the cam arm 49 type of FIGS. 6 and 7.

Referring to FIG. 3, the end 48 of screw 45 is rotatably mounted in the lower portion 46 of the block means, which portion is preferably substantially the same dimensions as foot segment 40 for maximizing the uniformity of pressure against the segment and the stability of the leg in the channel. In one preferred embodiment the bottom of portion 46 is roughened, as are shoulders 30 and 34 to positively prevent inopportune slippage of the chair leg in the channel once the block means has been tightened therein. The head 51 of the screw may be of any convenient type such as hex, Phillips, Allen, or wing nut.

Referring to FIGS. 6 and 7, a preferred type of pressure means comprises cam arm 49 which is pivotally mounted on pin 53 secured thru slot 55 in block means 32. The cam surface 57 of arm 49 is forced against foot segment 40 as the arm is rotated clockwise in FIG. 6. Suitable means may be provided for releasably retaining the arm in its tightened position such as the positioning of pin 52 to cause an overcentering of cam surface S7 as shown by the dotted lines in FIG. 6. It is noted that the orientation of the foot segment 40 of the molded plastic chairs for which the present invention is intended can vary, e.g., face longitudinally forwardly as shown in FIG. 2, or face in the reverse thereof Also, the present unit can be constructed to various dimensions to accommodate various size chair legs.

The present unit is affixed to the chair leg in the embodiment shown very simply and quickly by inserting the two legs of each side of a chair into channel 22 and then sliding the blocks 32 which were previously slid into the channel from the ends of the rocker, into the position as shown in FIG. 2. The screws 45, wedges 47 or cam arms 49 are then actuated to tighten the blocks against the rocker base and against the first shoulder means of the sides 18 and 20. For chairs on which the legs have forwardly and rearwardly facing foot segments, the blocks are slid into the channel from the ends thereof until they are juxtaposed against the legs.

Referring to FIGS. 9–12, an alternate embodiment is illustrated with common components bearing the same reference numerals. Comparable but distinctive parts bear the same reference numeral with the prime notation added, and parts not previously described bear their own reference numerals. This alternate embodiment includes a pair of upwardly curved channel shaped rockers 100' each having an elongated base 12 adapted to provide the bottom 14 of the rocker and to contact and rock on a supporting surface 16', first 18' and second 20' side members integrally connected to opposite edges of the base 12 and extending upwardly therefrom along substantially the full length thereof to provide a generally upwardly opening channel 22. As discussed above, channel 22 has a longitudinal plane, and a substantially uniform side-to-side width and base-to-shoulder height throughout its length.

Figure 9A:
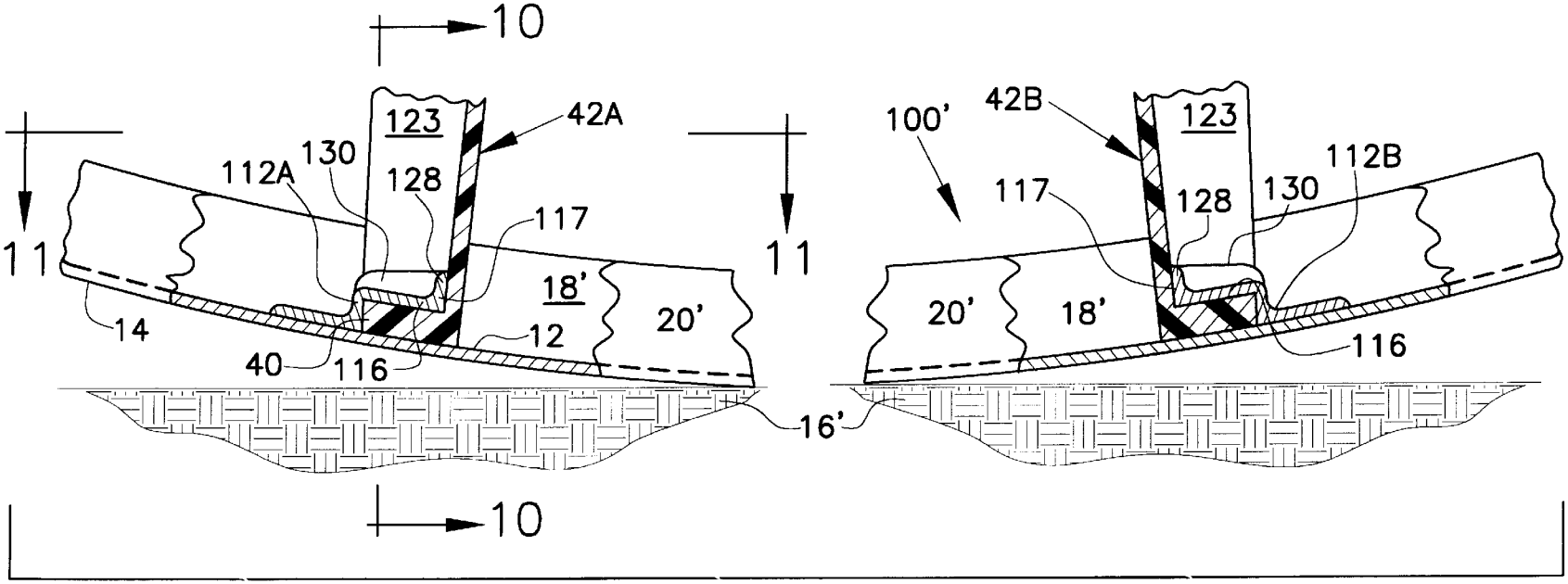
FIG. 9 is a side view of a rocker, with portions of a molded plastic chair leg frictionally engaged thereto and portions of the leg and rocker shown in cross-section for clarity.
Figure 9B:
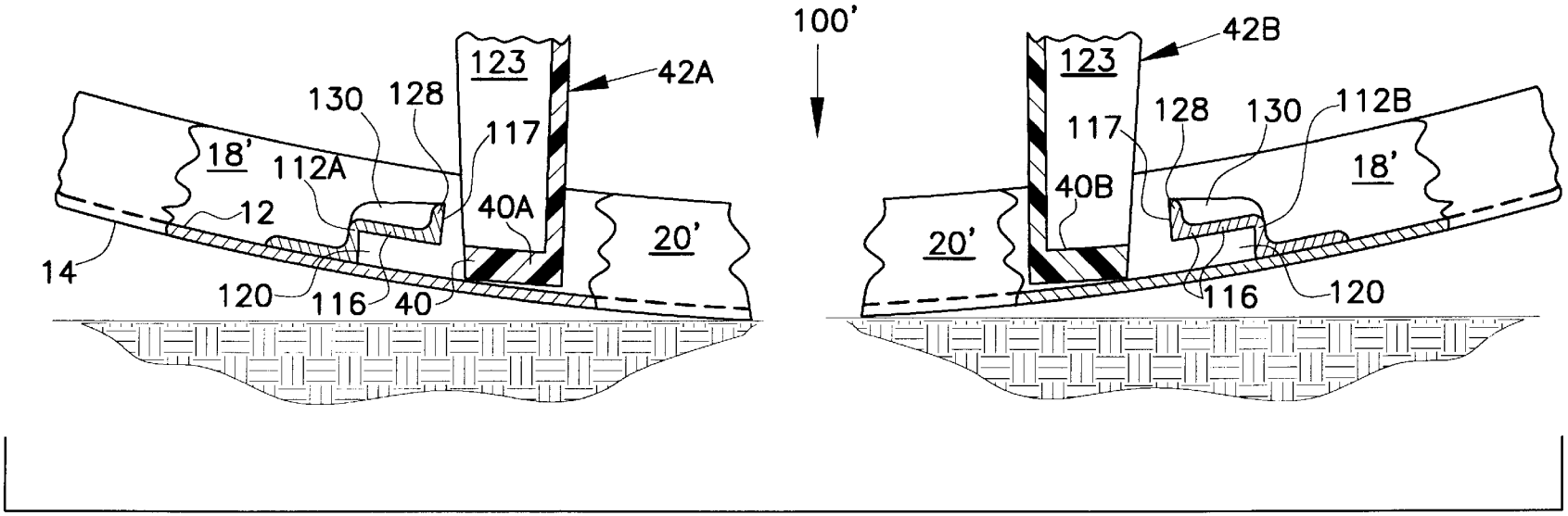
Figure 10:
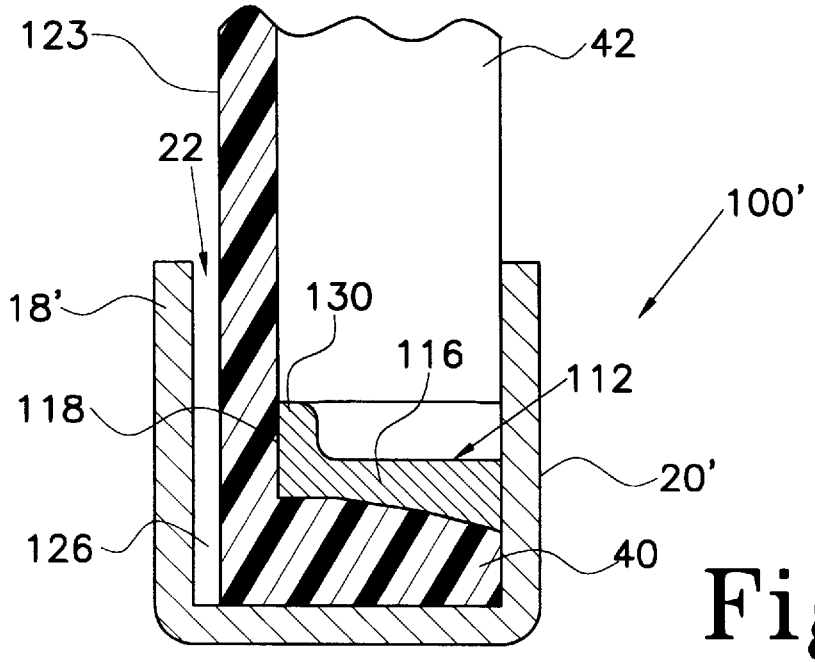
FIG. 10 is a view taken along line 10—10 of FIG. 9 in the direction of the arrows with portions broken away for clarity.
Figure 11:
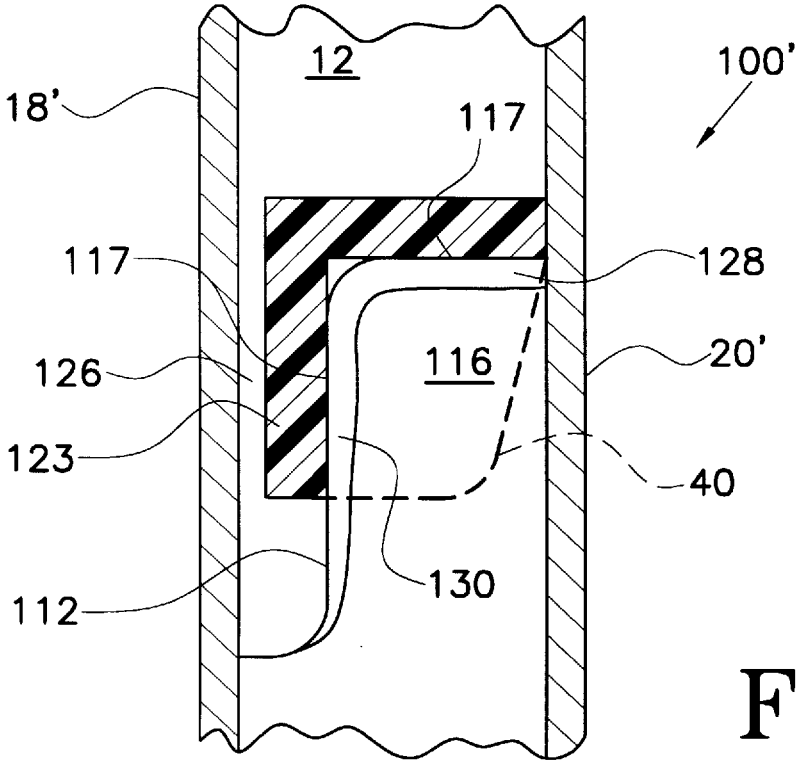
FIG. 11 is a view taken along line 11—11 of FIG. 9 in the direction of the arrows with portions broken away for clarity.
Figure 12:
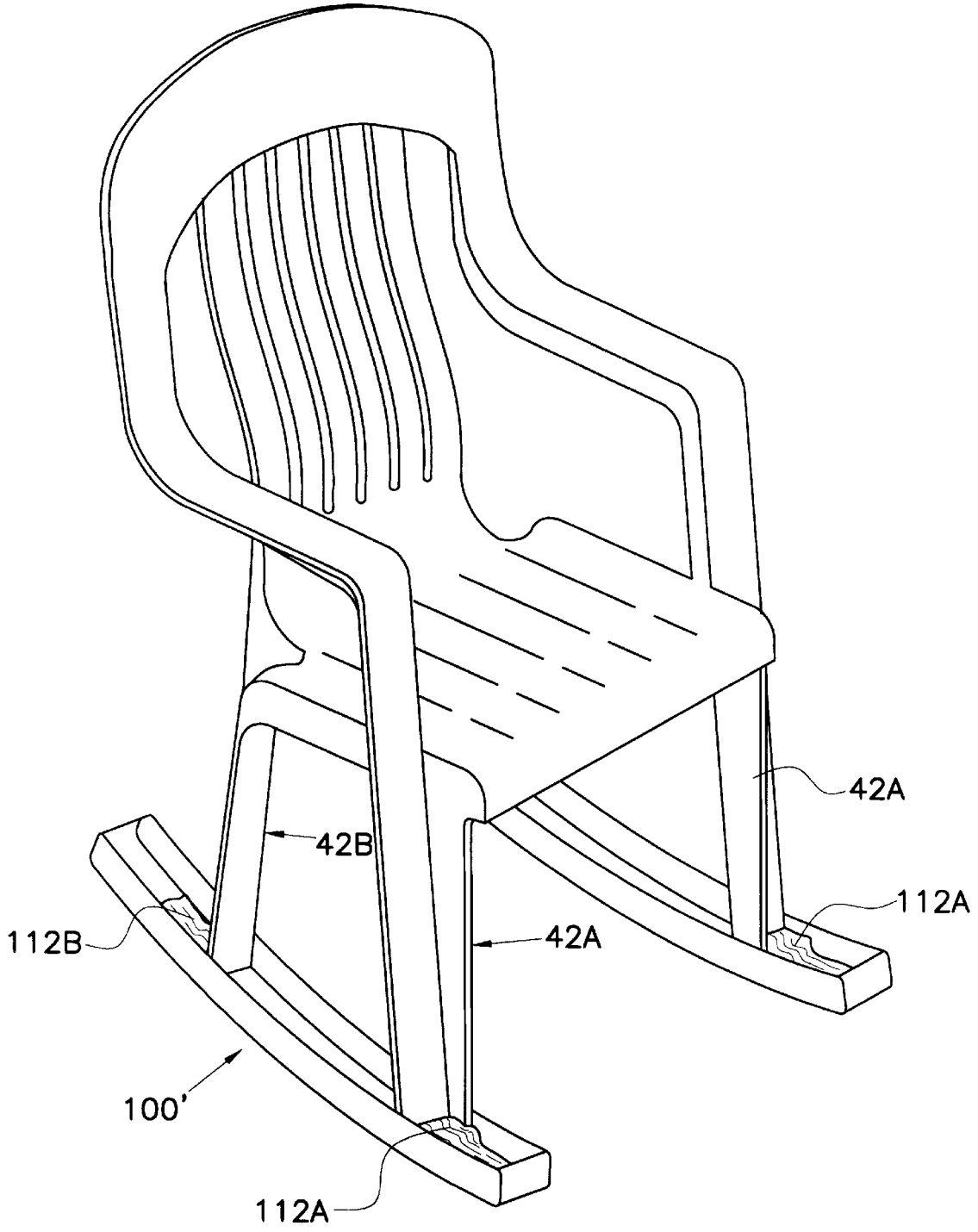
FIG. 12 is a perspective view of a rocker embodying an alternate embodiment of the present invention.

Disposed on the base 12 and within channel 22 are first 112A and second 112B foot retaining members for retaining the front 40A and rear 40B lateral foot segments, respectively, of a molded lawn chair leg 42 (see FIG. 9B). Those skilled in the art recognize that contemporary stackable molded lawn chairs incorporate legs that define angles such that the legs nest within the angle of a supporting lawn chair when the lawn chairs are stacked. It will be recognized by those skilled in the art that the channel 22 of the rocker 100 can be closed for cosmetic and aesthetic purposes if desired. Also, for outdoor use the rockers 100 could be provided with drain holes (not shown).

Foot retainer 112 includes a lateral member 116 displaced above base 12 and configured so as to provide a space 120 in which the lateral foot segment 40 can be positioned such that the lateral foot segment 40 is rigidly, frictionally locked in position against the base 12 and rocker 100' is stabilized on chair leg 42. Lateral member 116 has first 117 and second 118 perimeter edges that engage the angle of chair leg 42. Further, foot retainer 112A and 112B are displaced one from the other so as to substantially prevent longitudinal movement of chair leg 42 within channel 22. In this regard, foot retainer 112A and 112B are spaced apart from one another a distance that is substantially equal to the displacement of the front leg 42A from the rear leg 42B such that the front and rear chair legs have to be flexed towards each other in order to align lateral foot segment 40 with the space 120. The inherent resilience of leg 42 returns leg 42 to its normal position thereby adding lateral force against retainers and locking lateral foot segment 40 in space 120 in a tight frictional fit. Weight in the chair, as from a user sitting in the chair, increases this lateral force, and enhances the stability of the junction between chair and rocker. The relative positioning of the foot retainers 112 prevents front to rear movement of the chair leg 42 within the channel 22. The medial edge 123 of chair leg 42 is received in space 126 between foot retainer 112 and first side 18'. The tight frictional engagement between foot retainer 112 and lateral foot segment 40 minimizes side to side movement of chair leg 42 within channel 22. In this manner chair legs 42 are locked into rocker 100' in a tight frictional fit that stabilizes the rocker 100' on the chair. In order to increase surface area contact between retainers 112 and legs 42, first 128 and second 130 shoulders are provided on retainers 112 and are disposed on the first 117 and second 118 perimetric edges for engaging the angle of chair leg 42. This increased surface area contact enhances the stability of the junction between rocker 100' and chair leg 42.

While the embodiments described above have been described as having a substantially uniform side-to-side width and base-to-shoulder height throughout its length, it will be appreciated that the rockers can be manufactured to have a side-to-side width that tapers in order to accommodate chair legs of various dimensions.

From the foregoing description, it will be recognized by those skilled in the art that a modified rocker conversion for lawn-type chairs offering advantages over the prior art has been provided. Specifically, the modified rocker conversion for lawn-type chairs provides specially constructed units of rockers and friction fittings for connecting the relatively weak plastic molded legs of a modern lawn-type chair to said rockers, in a quick connect and disconnect manner. Further the modified rocker conversion for lawn-type chairs provide said units in lightweight, inexpensive, and easily manufacturable form, which lends to providing the unit in selected dimensions for accommodating a variety of molded chair legs.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A rocker conversion unit for affixing rockers to a molded plastic lawn chair, said unit comprising:

a pair of upwardly curved channel shaped rockers each having an elongated base providing a bottom of said rocker and adapted to contact and rock on a supporting surface, first and second side walls integrally connected to opposite edges of said base and extending upwardly therefrom along substantially the full length thereof to provide a generally upwardly opening channel bisected by a longitudinal plane; and a first and a second foot retainer disposed on said base and within said channel, being enclosed by said first and second side walls, said first and second foot retainers receiving and retaining a foot of a front chair leg and a foot of a rear chair leg, respectively, of a molded lawn chair, each said first and second foot retainer having a flat plate being horizontally disposed and in spaced relation above said base, each said first and second foot retainer providing a space between each said first and second foot retainer and said base in which a respective flat plate foot is received in a tight frictional fit and wherein each said first and second foot retainer includes first and second perimetric edges engaging a respective chair leg and being in spaced relation from a selected one of said side walls providing a space between said selected one of said side walls and each said first and second foot retainer thereby receiving a medial edge of the chair leg whereby each respective foot is received in said channel between said first and second side walls, is frictionally locked in position against said base, and said rocker is stabilized on the respective chair leg.

2. The rocker conversion unit of claim 1 wherein said channel has a substantially uniform side-to-side width.

3. The rocker conversion unit of claim 1 wherein each said first and second foot retainer further includes first and second shoulder members disposed on said first and second perimetric edges.

4. A rocker conversion unit for affixing rockers to a molded plastic lawn chair, said unit comprising:

a pair of upwardly curved channel shaped rockers each having an elongated base providing a bottom of said rocker and adapted to contact and rock on a supporting surface, first and second side walls integrally connected to opposite edges of said base and extending upwardly therefrom along substantially the full length thereof to provide a generally upwardly opening channel bisected by a longitudinal plane;

a first foot retainer disposed on said base and within said channel, and enclosed by said first and second side walls, said first foot retainer receiving and retaining a foot of a front chair leg of a molded lawn chair, said first foot retainer having a flat plate being substantially horizontally disposed and in spaced relation above said base providing a space between said first foot retainer and said base in which a respective flat plate foot of a respective front chair leg is received in a tight frictional fit, said first foot retainer further including first and second perimetric edges engaging the respective front chair leg and being in spaced relation from a selected one of said side walls providing a space between said selected one of said side walls and said first foot retainer thereby receiving a medial edge of the front chair leg; and a second foot retainer disposed on said base and within said channel, and enclosed by said first and second side walls, in spaced relation from said first foot retainer, said second foot retainer receiving and retaining a foot of a rear chair leg of a molded lawn chair, said second foot retainer having a flat plate being substantially horizontally disposed and in spaced relation above said base providing a space between said second foot retainer and said base in which a respective flat plate foot of a respective rear chair leg is received in a tight frictional fit, said second foot retainer further including first and second perimetric edges engaging the respective rear chair leg and being in spaced relation from a selected one of said side walls providing a space between said selected one of said side walls and said second foot retainer thereby receiving a medial edge of the rear chair leg wherein said first foot retainer and said second foot retainer are spaced apart from one another a dimension substantially equal to a distance between the foot of the front chair leg and the foot of the rear chair leg, whereby each respective foot of each of the respective front and rear chair legs is received in said channel between said first and second side walls, is engaged by a respective said foot retainer in a tight frictional fit, and said rocker is stabilized on each respective chair leg.

5. The rocker conversion unit of claim 4 wherein said channel has a substantially uniform side-to-side width.

6. The rocker conversion unit of claim 4 wherein each said first and second foot retainer further includes first and second shoulder members disposed on said first and second perimetric edges.

* * * * *